US006546876B2

(12) United States Patent
Theurer et al.

(10) Patent No.: US 6,546,876 B2
(45) Date of Patent: Apr. 15, 2003

(54) TAMPING MACHINE HAVING A MEASURING SENSOR COUPLED TO MECHANICAL MEASURING DEVICE ON AN AUXILIARY TRACK

(75) Inventors: Josef Theurer, Vienna (AT); Bernhard Lichtberger, Leonding (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 09/873,575

(22) Filed: Jun. 4, 2001

(65) Prior Publication Data

US 2001/0050021 A1 Dec. 13, 2001

(30) Foreign Application Priority Data

Jun. 9, 2000 (AT) ..... GM 434/2000

(51) Int. Cl.[7] ..... E01B 29/04
(52) U.S. Cl. ..... 104/7.2; 104/7.1
(58) Field of Search ..... 104/7.2, 7.1, 10, 104/12, 2; 33/287; 73/862.637, 862.638, 862.639

(56) References Cited

U.S. PATENT DOCUMENTS 3,821,933 A * 7/1974 Plasser et al. ..... 104/8
4,625,651 A * 12/1986 Theurer ..... 104/7.2
4,655,142 A * 4/1987 Theurer et al. ..... 104/7.1
4,905,604 A * 3/1990 Theurer ..... 104/7.2
5,379,700 A * 1/1995 Theurer ..... 104/7.2
5,481,982 A * 1/1996 Theurer et al. ..... 104/7.2
5,515,788 A * 5/1996 Theurer et al. ..... 104/12

* cited by examiner

*Primary Examiner*—S. Joseph Morano
*Assistant Examiner*—Frantz F. Jules
(74) *Attorney, Agent, or Firm*—Henry M. Feiereisen

(57) ABSTRACT

A mobile tamping machine for tamping ballast under a railroad track includes a machine frame supported on undercarriages running on a main track for moving the machine in an operating direction. A tamping unit is mounted on the machine frame between the undercarriages, and a track lifting and lining unit for leveling and lining the main track is vertically and transversely adjustably mounted on the machine frame immediately ahead of the tamping unit in the operating direction, with drives being provided for vertically and transversely adjusting the track lifting and lining unit. An auxiliary lifting unit is mounted on the machine frame for lifting a branch track branching off the main track at a track switch. A common measuring system associated with the track lifting and lining unit and the auxiliary lifting unit is provided for controlling the lifting of the track switch. The common measuring system includes a mechanical measuring device, which connects the track lifting and lining unit to the auxiliary lifting device and is telescopically extensible transversely to the longitudinal direction of the machine frame, and a measuring sensor.

9 Claims, 2 Drawing Sheets

TAMPING MACHINE HAVING A MEASURING SENSOR COUPLED TO MECHANICAL MEASURING DEVICE ON AN AUXILIARY TRACK

CROSS-REFERENCES TO RELATED APPLICATIONS

This application claims the priority of Austrian Patent Application Serial No. GM 434/2000, filed Jun. 9, 2000.

BACKGROUND OF THE INVENTION

The present invention relates, in general, to a track maintenance machine, and more particularly to a mobile tamping machine for tamping ballast under a railroad track.

U.S. Pat. No. 4,905,604 describes a tamping machine for tamping straight and switch sections of a railroad track. The tamping machine includes a machine frame which is supported on undercarriages for travel on a main track in an operating direction. A tamping unit is mounted on the machine frame between the undercarriages, and a track lifting and lining unit is vertically and transversely adjustably mounted on the machine frame immediately ahead of the tamping unit in the operating direction for leveling and lining the main track. In addition, the tamping machine includes an auxiliary lifting unit which is mounted on the machine frame for lifting a branch track branching off the main track at a track switch. A special measuring system is provided to control the lifting of the branch track by the auxiliary lifting unit, and includes a measuring axle running on the main track and another measuring axle running on the branch track. The two measuring axles are coupled together by a rod carrying a cross level indicator. In this manner, an operator is able to lift the branch track by remote-controlled operation of the auxiliary lifting unit to accurately conform a lifting of the branch track to a lifting of the main track by closely monitoring the cross level indicator.

It would be desirable and advantageous to provide an improved tamping machine which is simple in structure and yet ensures an exact conformity between the vertical positions of the main and branch tracks at a switch.

SUMMARY OF THE INVENTION

According to one aspect of the present invention, a tamping machine includes a machine frame supported on undercarriages for travel on a main track in an operating direction; a tamping unit mounted on the machine frame between the undercarriages; a track lifting and lining unit, vertically and transversely adjustably mounted on the machine frame immediately ahead of the tamping unit in the operating direction, for leveling and lining the main track; drive means for vertically and transversely adjusting the track lifting and lining unit; an auxiliary lifting unit, mounted on the machine frame, for lifting a branch track branching off the main track at a track switch; and a measuring system, operatively connected to both the track lifting and lining unit and the auxiliary lifting unit, for controlling a lifting of the track switch, wherein the measuring system includes a mechanical measuring device, which connects the track lifting and lining unit to the auxiliary lifting device and is telescopically extendible in a direction transversely to the longitudinal axis of the machine frame, and a measuring sensor.

Such a common measuring system has a simple configuration and is yet able to realize an automatic and accurate coordination of both the track lifting and lining unit and the auxiliary lifting unit. In this way, an accurate and swift track position correction can be accomplished without any problems, even when track switches are involved which have long ties with an elastic joint. As a consequence of the simplicity of the measuring system, the correction of the track position is not impaired in any way and the operator's view of the track remains unobstructed.

According to another feature of the present invention, the mechanical measuring device may be a cable and the measuring sensor may be a rotary potentiometer operatively connected to the cable. Another option may include the configuration of the measuring device as a measuring beam and the configuration of the measuring sensor as a goniometer operatively connected to the measuring beam. Suitably, the measuring beam is configured so as to be telescopically extendible.

According to another feature of the present invention, the tamping machine may further include a lifting drive, connected to the auxiliary lifting unit, for lifting the branch track, and a control device, connected to the measuring sensor, for actuating the lifting drive.

BRIEF DESCRIPTION OF THE DRAWING

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
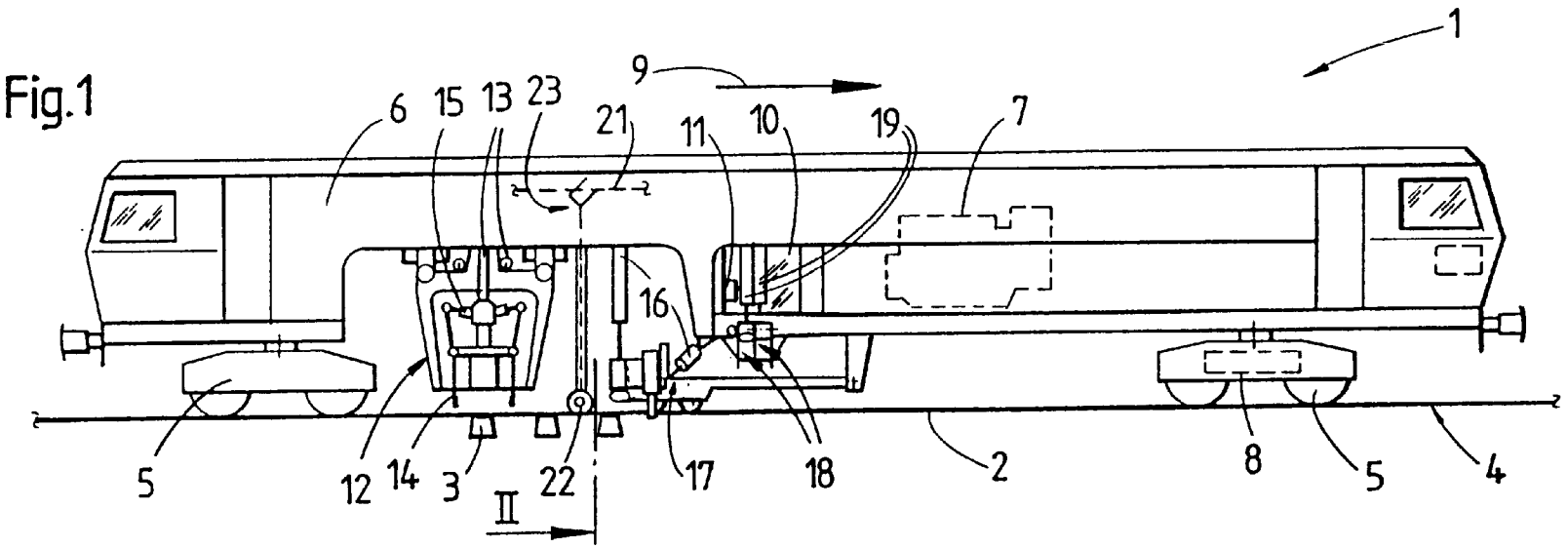
FIG. 1 is a simplified side elevational view of one embodiment of a tamping machine according to this invention.

Throughout all the Figures, same or corresponding elements are generally indicated by same reference numerals.

Turning now to the drawing, and in particular to FIG. 1, there is shown a simplified side elevation of one embodiment of a mobile tamping machine according to the invention, generally designated by reference numeral 1, for tamping ballast under a track 4 which defines a track plane 39 (FIG. 2) and is comprised of rails 2 fastened to ties 3. The illustrated tamping machine 1 includes a machine frame 6 which is supported on undercarriages 5 for travel on the track 4 by means of a motive drive 8 actuated by a motor 7 in an operating direction indicated by arrow 9. An operator's cab 10 houses a control device 11 for operating the various operating devices and drives of the machine.

Figure 2:
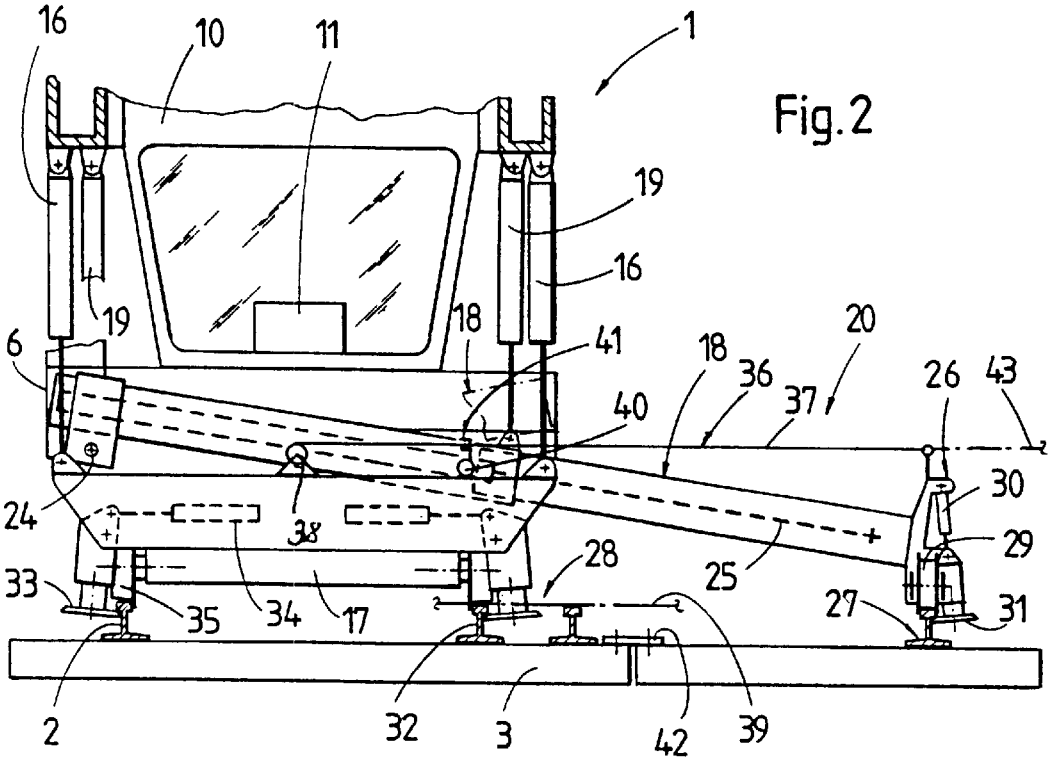
FIG. 2 is an enlarged cross sectional view of the tamping machine taken along the line II in FIG. 1.

A tamping unit 12 for tamping ballast of the track 4 is mounted on the machine frame 6 between the undercarriages 5 and vertically and transversely adjustable by drives 13. The tamping unit 12, involved here, is of conventional design and suitable in particular for use in track switches. An exemplified track switch 28 is shown in FIG. 2 and has a long tie 3 which connects a main track 32 to a branch track 27, branching off the main track 32, and is comprised of two tie parts linked together by an elastic joint 42. The tamping unit 12 includes tamping tines 14 which are immersible into the ballast and may be moved relative to one another in longitudinal direction of the machine frame 6 by reciprocating drives 15. Structure and operation of a tamping unit of this type is generally known and not described in more detail for sake of simplicity.

A track lifting and lining unit 17 for leveling and lining the track 4, i.e. a main track 32 (FIG. 2), is mounted on the machine frame 6 immediately ahead of the tamping unit 12 in the operating direction and configured for movement in vertical and transverse directions by drives 16. The track lifting and lining unit 17 travels on the main track 32 and includes flanged rollers 35, which run on the rails 2 of the main track 32, and lifting rollers 33, which are actuated by drives 34 so as to be engageable under the head of the rails 2. The drives 16 for lifting the track 4 are controlled by a track position measuring system 23 which is indicated in FIG. 1 by a reference chord 21 engaged by a measuring axle 22 running on the track 4. All of the heretofore described structure and operation is entirely conventional and are illustrated only schematically for sake of simplicity.

A pair of identical auxiliary lifting units 18, shown here only schematically, are mounted on the machine frame 6 adjacent to the track lifting and lining unit 17 for lifting the branch track 27 which branches off the main track 32 at the track switch 28. The auxiliary lifting units 18 are so mounted to the machine frame 6 as to allow optional lifting of a branch track 27 on either side of the main track 32, i.e. one auxiliary lifting unit 18 is provided to lift a branch track 27 on one side of the main track 32 and the other auxiliary lifting unit 18 is provided to lift a branch track 27 on the other side of the main track 32.

As shown in FIG. 2, one end of each auxiliary lifting unit 18 is linked to the machine frame 6 by a joint 24 defined by an axis which extends in a longitudinal direction of the machine frame 6, whereby the auxiliary lifting units 18 extend transversely to the longitudinal direction of the machine frame 6. Each auxiliary lifting unit 18 is vertically adjustable by a drive 19 and extendible transversely to the machine frame 6 by a drive 25. A lifting device 26 is mounted to the joint-distal end of each auxiliary lifting unit 18 and essentially includes a double-flanged roller 29, which rolls along a rail of the branch track 27, and a lifting roller 31, which is adjustable by a drive 30 for engagement under the head of the rail of the branch track 27.

A measuring system 20 is operatively connected to both the track lifting and lining unit 17 and a one of the auxiliary lifting units 18 for controlling the lifting of the track switch 28 and includes a mechanical measuring device 36 which is configured for extension transversely to the direction of longitudinal direction of the machine frame 6 and links the track lifting and lining unit 17 to the auxiliary lifting unit 18. Although not shown in detail, it will be appreciated by persons skilled in the art that an analogous measuring system is provided to operatively connect the track lifting and lining unit 17 with the other one of the auxiliary lifting units 18, shown only by dash-dot line in FIG. 2. However, as the measuring systems 20 are of an identical construction, it will be understood by persons skilled in the art that a description of one of the measuring systems 20 is equally applicable to the other measuring system.

The measuring device 36 includes a cable 37 which defines a reference line of the measuring system 20. The reference line coincides with a measuring plane 43 and extends parallel to the track plane 39 when the track switch 28 is properly positioned. The cable 37 of the measuring device 36 is wound on a spool 38, attached on the track lifting and lining unit 17, and is secured to the lifting device 26 of the auxiliary lifting unit 18. The cable 37 has a length sufficient to follow an extension of the auxiliary lifting unit 18, when the auxiliary lifting unit 18 is extended transversely to the longitudinal direction of the machine frame 6 to the distal rail of the branch track 27. The measuring system 20 further includes a measuring sensor 41 which sends signals to the control device 11 in response to a disposition of the cable 37 with respect to the track plane 39, for corresponding operation of the drive 19 for the auxiliary lifting unit 18. In the nonlimiting example of FIGS. 1 and 2, the measuring sensor 41 is designed as a rotary potentiometer 40.

The tamping machine 1 according to the present invention is operated as follows: As the tamping machine 1 advances along the track 4 to the track switch 28, the track position of the main track 32 is corrected under the control of the track position measuring system 23 to level and/or line the main track 32 through actuation of the track lifting and lining unit 17 and by tamping the ballast under the ties 3 of the corrected track through actuation of the tamping unit 12. As soon as the tamping machine 1 reaches the track switch 28, a respective one of the auxiliary lifting units 18 is laterally extended on the side of the branch track 27 by actuating the drive 25, and the lifting device 26 is engaged with a rail of the branch track 27. The subsequent correction of the position of the track switch 28 follows automatically as drives 16 adjust the track lifting and lining unit 17 for lifting the track lifting and lining unit 17 together with the measuring device 36 to the desired position.

As the track position correction proceeds by the adjustment of the track lifting and lining unit 17, the cable 37 forms the measuring plane 43, and the drive 19 of the auxiliary lifting unit 18 is actuated to lift the branch track 27, engaged by the lifting device 26, until the switch 28 is aligned in the correct position. This is the case when the track plane 39 and the measuring plane 43 extend parallel to one another. As soon as the parallel relationship is realized, the rotary potentiometer 40 emits a signal to the control device 11, and the actuation of the drive 19 of the auxiliary lifting unit 18 ceases. As a result, the branch track 27 of the switch 28 is positioned precisely in the track plane 39 of the main track 32.

Figure 3:
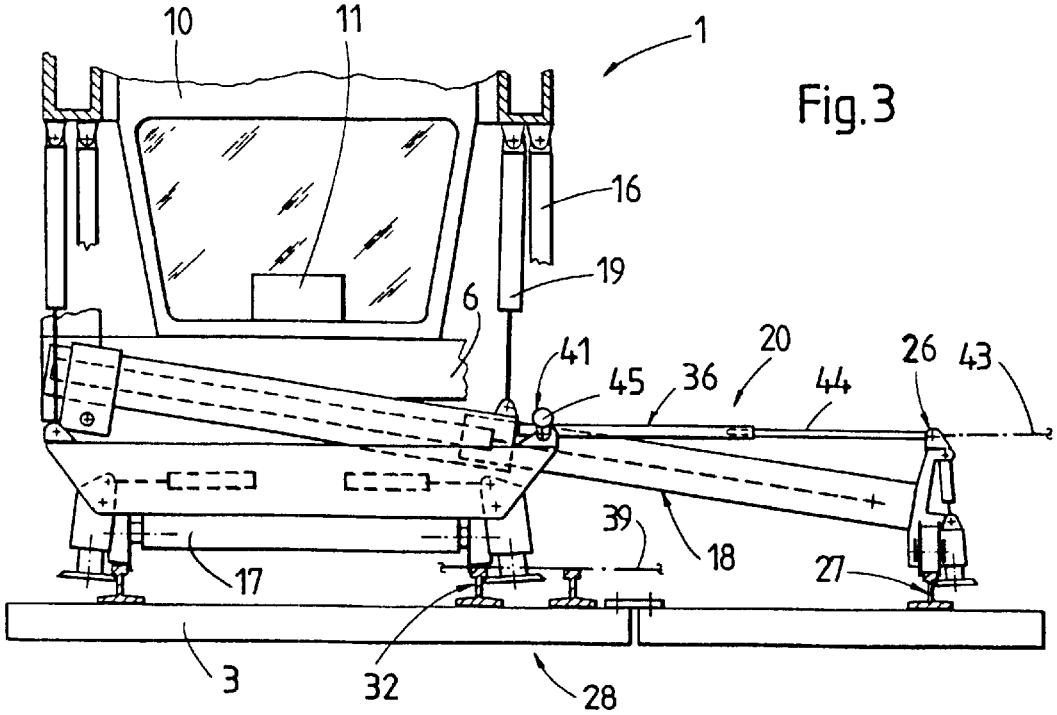
FIG. 3 is an enlarged cross sectional view of another embodiment of a tamping machine according to the invention.

FIG. 3 illustrates another embodiment of a tamping machine 1 according to the invention. Parts corresponding with those in FIG. 1 are denoted by identical reference numerals and not explained again. In this embodiment, the measuring device 36 includes a measuring beam 44 which is telescopically extendible transversely to the machine frame 6. The measuring sensor 41 associated with the measuring beam 44 and fastened to the track lifting and lining unit 17 is hereby designed as a goniometer 45. The goniometer 45 is adjusted in such a way that a signal is emitted to the control device 11, when the track plane 39 and the measuring plane 43 extend parallel to one another. Actuation of the drive 19 is then stopped, since the accurate position of the branch track 27 has been reached.

While the invention has been illustrated and described as embodied in a tamping machine, it is not intended to be limited to the details shown since various modifications and structural changes may be made without departing in any way from the spirit of the present invention.

What is claimed as new and desired to be protected by Letters Patent is set forth in the appended claims:

1. A mobile tamping machine for tamping ballast under a railroad, comprising:

(a) a machine frame defining a longitudinal axis and supported on undercarriages for travel on a main track in an operating direction;

(b) a tamping unit mounted on the machine frame between the undercarriages;

(c) a track lifting and lining unit, vertically and transversely adjustably mounted on the machine frame immediately ahead of the tamping unit in the operating direction, for leveling and lining the main track;

(d) drive means for vertically and transversely adjusting the track lifting and lining unit;

(e) an auxiliary lifting unit, mounted on the machine frame, for lifting a branch track branching off the main track at a track switch; and (f) a measuring system, operatively connected to both the track lifting and lining unit and the auxiliary lifting unit, for controlling a lifting of the track switch, said measuring system including a mechanical measuring device, which connects the track lifting and lining unit to the auxiliary lifting device and is extendible in a direction transversely to the longitudinal axis of the machine frame, and a measuring sensor, wherein the mechanical measuring device is a cable, and the measuring sensor is a rotary potentiometer operatively connected to the cable.

2. The tamping machine of claim 1, further comprising a lifting drive, connected to the auxiliary lifting unit, for lifting the branch track, and a control device, connected to the measuring sensor, for actuating the lifting drive.

3. A mobile tamping machine for tamping ballast under a railroad, comprising:

(a) a machine frame defining a longitudinal axis and supported on undercarriages for travel on a main track in an operating direction;

(b) a tamping unit mounted on the machine frame between the undercarriages;

(c) a track lifting and lining unit, vertically arid transversely adjustably mounted on the machine frame immediately ahead of the tamping unit in the operating direction, for leveling and lining the main track;

(d) drive means for vertically and transversely adjusting the track lifting and lining unit;

(e) an auxiliary lifting unit, mounted on the machine frame, for lifting a branch track branching off the main track at a track switch; and (f) a measuring system, operatively connected to both the track lifting and lining unit and the auxiliary lifting unit, for controlling a lifting of the track switch, said measuring system including a mechanical measuring device, which connects the track lifting and lining unit to the auxiliary lifting device and is extendible in a direction transversely to the longitudinal axis of the machine frame, and a measuring sensor, wherein the mechanical measuring device is a measuring beam, and the measuring sensor is a goniometer operatively connected to the measuring beam, wherein the measuring beam is configured so as to be telescopically extendible.

4. The tamping machine of claim 3, and further comprising a lifting drive, connected to the auxiliary lifting unit, for lifting the branch track, and a control device, connected to the measuring sensor, for actuating the lifting drive.

5. A track maintenance machine for proper positioning of a track switch comprised of a main track and a branch track, comprising:

a machine frame defining a longitudinal axis and supported on undercarriages for travel on the main track;

a first unit, mounted to the machine frame, for lifting the main track;

a second unit, mounted to the machine frame, for lifting the branch track, said second unit configured for extension in a direction transversely to the longitudinal axis; and a measuring system including an extendible measuring device, which has one end connected to the first unit and another end connected to the second unit, and a measuring sensor, which monitors a disposition of the measuring device with respect to a track plane as defined by the main track to thereby control a lifting operation of the second unit, and generates a stop signal to terminate the lifting operation, when the measuring device extends in parallel relationship to the track plane, wherein the measuring system has a spool secured to the first unit, said measuring device being a cable which is wound onto the spool.

6. The machine of claim 5, wherein the measuring sensor is a rotary potentiometer.

7. The machine of claim 5, and further comprising a control device operatively connected to the measuring sensor for controlling the lifting operation of the second unit.

8. A track maintenance machine for proper positioning of a track switch comprised of a main track and a branch track, comprising:

a machine frame defining a longitudinal axis and supported on undercarriages for travel on the main track;

a first unit, mounted to the machine frame, for lifting the main track;

a second unit, mounted to the machine frame, for lifting the branch track, said second unit configured for extension in a direction transversely to the longitudinal axis; and a measuring system including an extendible measuring device, which has one end connected to the first unit and another end connected to the second unit, and a measuring sensor, which monitors a disposition of the measuring device with respect to a track plane as defined by the main track to thereby control a lifting operation of the second unit, and generates a stop signal to terminate the lifting operation, when the measuring device extends in parallel relationship to the track plane, wherein the measuring device is a measuring beam, and the measuring sensor is a goniometer, wherein the measuring beam is configured so as to be telescopically extendible.

9. The machine of claim 8, and further comprising a control device operatively connected to the measuring sensor for controlling the lifting operation of the second unit.

* * * * *